US011499298B2

(12) United States Patent
Congdon et al.

(10) Patent No.: US 11,499,298 B2
(45) Date of Patent: Nov. 15, 2022

(54) CORNER SEGMENT HAVING PROTRUSIONS ON WEAR ZONES

(71) Applicant: Caterpillar Inc., Peoria, IL (US)

(72) Inventors: Thomas M. Congdon, Dunlap, IL (US); Nathan Bjerke, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 269 days.

(21) Appl. No.: 16/861,664

(22) Filed: Apr. 29, 2020

(65) Prior Publication Data

US 2021/0340739 A1 Nov. 4, 2021

(51) Int. Cl.
*E02F 9/28* (2006.01)

(52) U.S. Cl.
CPC ..... *E02F 9/2858* (2013.01)

(58) Field of Classification Search
CPC ..... E02F 3/8152; E02F 9/2858; E02F 9/2883
See application file for complete search history.

(56) References Cited

U.S. PATENT DOCUMENTS

| | | | | |
|---|---|---|---|---|
| 4,069,604 | A * | 1/1978 | Stepe | E02F 9/28 172/701.2 |
| 4,187,626 | A | 2/1980 | Greer et al. | |
| 4,500,766 | A * | 2/1985 | Reinhardt | B23K 31/025 219/76.1 |
| 4,756,102 | A | 7/1988 | Chapman | |
| 4,883,129 | A | 11/1989 | Lonn et al. | |
| 5,647,448 | A | 7/1997 | Skaggs | |
| 5,954,282 | A * | 9/1999 | Britzke | B02C 13/1814 241/275 |
| 5,966,848 | A * | 10/1999 | Monteiro, Jr. | E02F 9/2858 299/102 |
| 6,003,617 | A | 12/1999 | McSweeney | |
| 6,571,493 | B2 | 6/2003 | Amano et al. | |
| 6,799,385 | B2 * | 10/2004 | Champney | E02F 9/2858 37/453 |
| 6,854,527 | B2 | 2/2005 | Manway et al. | |
| 8,241,761 | B2 * | 8/2012 | Garber | B02C 1/10 428/685 |
| 8,281,505 | B2 | 10/2012 | Karlsson et al. | |
| 9,840,825 | B2 * | 12/2017 | Biggs | E02F 3/8152 |
| 10,066,371 | B2 | 9/2018 | Winter | |
| 10,808,376 | B2 * | 10/2020 | Bjerke | E02F 3/8152 |
| 2009/0101370 | A1 * | 4/2009 | Tasovski | B60P 1/286 172/1 |

FOREIGN PATENT DOCUMENTS

| | | | |
|---|---|---|---|
| WO | 2013/030191 | A1 * | 2/2013 |
| WO | 2015017894 | | 2/2015 |

* cited by examiner

*Primary Examiner* — Gary S Hartmann
(74) *Attorney, Agent, or Firm* — Bookoff McAndrews PLLC

(57) ABSTRACT

A corner segment, configured to be mounted to a work implement, may include a body having a plurality of surfaces including a rear surface, an upper surface, a front surface, a bottom surface, an outer side surface, an inner side surface, and a corner surface that is adjacent to each of the front surface, the outer side surface, the upper surface, and the bottom surface. A portion of the bottom surface forms a bottom surface wear zone, and a portion of the front surface forms a front surface wear zone, The corner segment may also include a plurality of protrusions provided on wear zones, the wear zones including the bottom surface wear zone and the front surface wear zone.

16 Claims, 6 Drawing Sheets

CORNER SEGMENT HAVING PROTRUSIONS ON WEAR ZONES

TECHNICAL FIELD

The present disclosure relates generally to a corner segment mountable on a ground engaging tool, such as a bucket of a wheel loader, and, more particularly, to a corner segment having protrusions provided on wear zones of the corner segment.

BACKGROUND

A work implement, such as a bucket, is mounted to a machine and used to dig into and to move materials, such as sand, gravel, stone, soil, or debris. The bucket may have a ground engaging tool (GET) mounted to an edge of the bucket. The GET engages with the materials to protect the edge of the bucket from wear and, therefore, prolongs the life of the bucket. Wash-out, or accelerated wear, may occur on only some portions of the GET, such as a corner of the GET. As a result, the life of the GET is reduced to a life of the portion subjected to accelerated wear. Replacement of the GET is costly due to the expense of a new GET, downtime during replacement, and the effort and expense associated with the replacement process.

To reduce the frequency of replacement of the work implement, wear plates may be used. As described in U.S. Pat. No. 10,066,371, for example, rectangular wear plates can be tack welded along outer surfaces of end walls of a bucket. Carbide matrix deposits or plugs are formed on the wear plates by filling or overfilling a plurality of holes drilled into the wear plate. The plugs are arranged in a grid like pattern across an entire surface of the wear plate.

When the wear plates, such as those described in the '317 patent, are attached to end walls of the bucket, the wear plates protrude from surfaces of the end walls by an amount equal to a thickness of the wear plates. That is, the wear plates are not co-planar with surfaces of the end wall of the bucket. Moreover, the flat, rectangular wear plates may not be suitable for attachment to a non-planar surface of the bucket, such as a corner segment or a lip of the bucket. Replacement of the wear plates may require burning, cutting, and welding, which can be time consuming and costly, requires additional tools or machinery, and requires manual labor.

The corner segment of the present disclosure may solve one or more of the problems set forth above and/or other problems in the art. The scope of the current disclosure, however, is defined by the attached claims, and not by the ability to solve any specific problem.

SUMMARY

In one aspect, a corner segment, configured to be mounted to a work implement, may include a body having a plurality of surfaces including a rear surface, an upper surface, a front surface, a bottom surface, an outer side surface, an inner side surface, and a corner surface that is adjacent to each of the front surface, the outer side surface, the upper surface, and the bottom surface. A portion of the bottom surface forms a bottom surface wear zone, and a portion of the front surface forms a front surface wear zone. The corner segment may also include a plurality of protrusions provided on wear zones, the wear zones including the bottom surface wear zone and the front surface wear zone.

In another aspect, a corner segment, configured to be mounted to a work implement, may include a body including a mounting portion for mounting to the wheel loader bucket, the mounting portion having a mounting portion outer side surface, and a lip portion, integrally formed with the mounting portion. The lip portion has a lip portion front surface, a lip portion upper surface, a lip portion bottom surface, and a lip portion outer corner surface that is adjacent to each of the lip portion front surface, the lip portion upper surface, the lip portion bottom surface, and the mounting portion outer side surface. A portion of the lip portion bottom surface forms a bottom surface wear zone, and a portion of the lip portion front surface forms a front surface wear zone. The corner segment may also include a plurality of protrusions provided on wear zones, the wear zones including the bottom surface wear zone and the front surface wear zone.

In still another aspect, a corner segment, mountable to a work implement, may include a mounting portion configured to attach to the bucket, and a working surface portion integrally formed with the mounting portion. The working surface portion may include a front surface, an upper surface, a bottom surface, and an outer corner surface adjacent to each of the front surface, the upper surface, and the bottom surface. A portion of the bottom surface forms a bottom surface wear zone, a portion of the front surface forms a front surface wear zone, and the corner surface forms a corner surface wear zone. The corner segment may also include a plurality of protrusions provided on wear zones, the wear zones including the bottom surface wear zone, the side surface wear zone, the front surface wear zone, and the corner surface wear zone.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion, such that a process, method, article, or apparatus that comprises a list of elements does not include only those elements, but may include other elements not expressly listed or inherent to such a process, method, article, or apparatus. Moreover, in this disclosure, relative terms, such as, for example, "about," "generally, "substantially," and "approximately" are used to indicate a possible variation of ±10% in the stated value.

Figure 1:
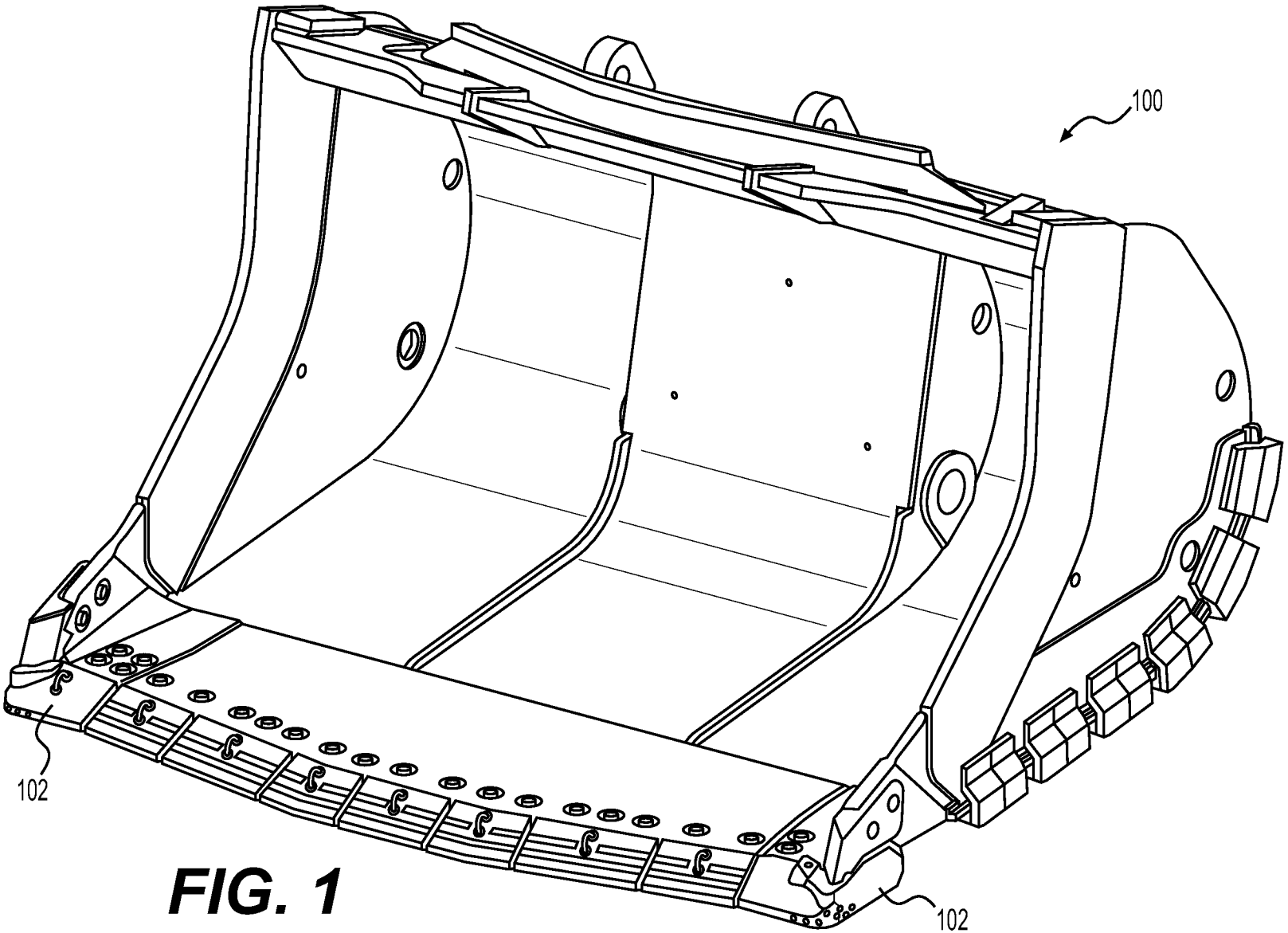
FIG. 1 shows a schematic view of a bucket, as an example of a work implement, having corner segments as GETs, in accordance with the present disclosure.

FIG. 1 shows a schematic view of a bucket 100, as an example of a work implement, of a wheel loader, having two corner segments 102 as ground engaging tools (GETs) mounted to the bucket 100. The corner segments 102 are attached to corners of a front surface of the bucket 100, with surfaces of the corner segments 102, described in detail below, being exposed and engaging with a material, e.g., sand, gravel, stone, soil, debris, or a combination thereof. The corner segments 102 may be formed of steel, for example. The material that forms the corner segments 102 is not, however, limited to steel, and other materials may be used.

Figure 2:
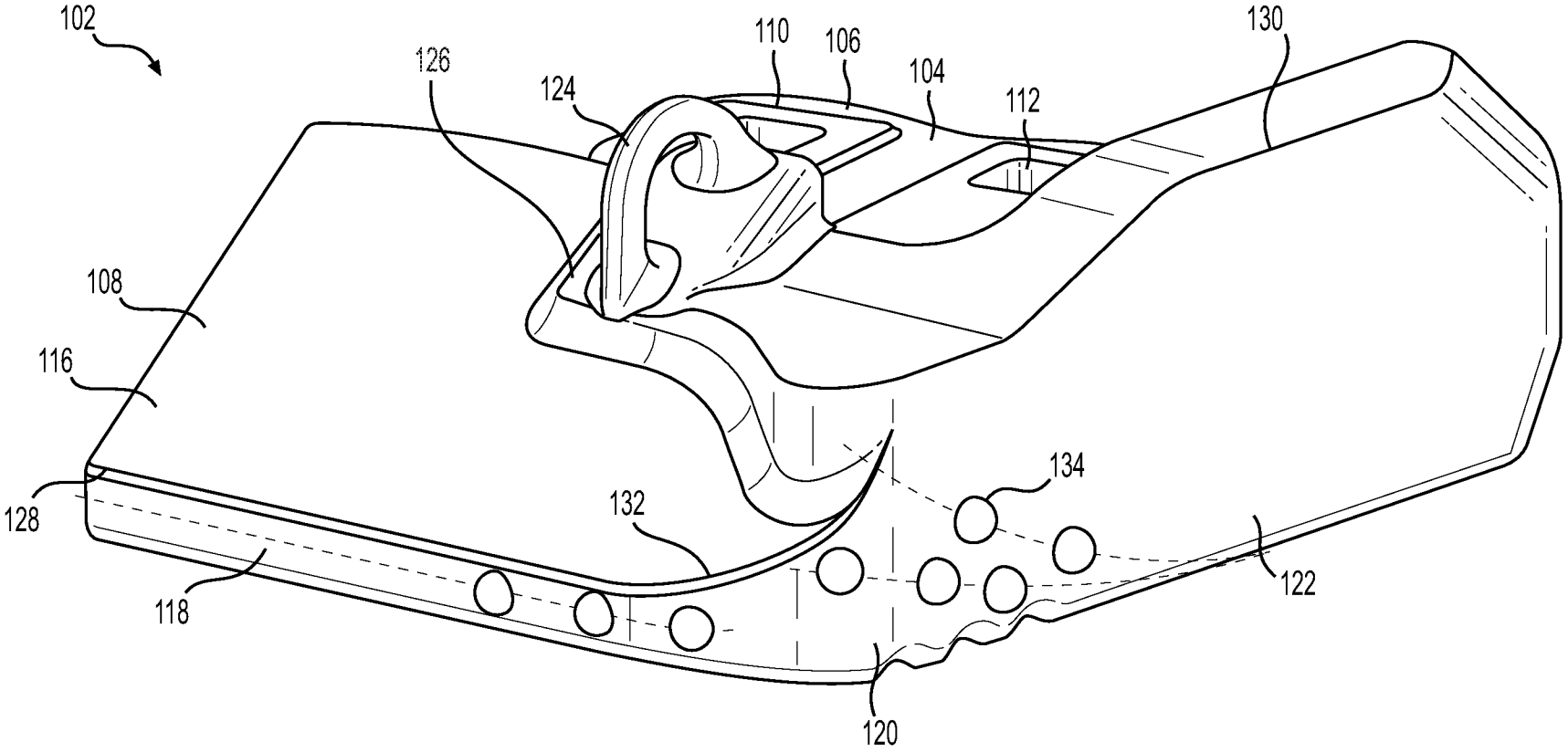
FIG. 2 shows a schematic isometric view of the corner segment shown in FIG. 1, including at least an upper surface, a front surface, a corner surface, and an outer side surface of the corner segment.

FIG. 2 shows a schematic isometric view of a corner segment 102, according to the present disclosure. As shown in FIG. 2, the corner segment 102 has a body 104 that includes a recessed mounting portion 106, which can be mounted to the bucket 100, and a lip portion 108 integrally formed with the recessed mounting portion 106. The recessed mounting portion 106 has a mounting portion upper surface 110, and one or more through holes 112 for mounting and securing the corner segment 102 to the bucket 100. The mounting portion upper surface 110 may be a planar surface. The one or more through holes 112 may extend through the recessed mounting portion 106, from the mounting portion upper surface 110 to a mounting portion lower surface 114 (shown in FIG. 3). A shape of the through holes 112 may correspond to a shape of a fastener, such as a bolt (not shown), or another component, used to secure the corner segment 102 to the bucket 100.

As shown in FIG. 2, the lip portion 108 includes a lip portion upper surface 116, a lip portion front surface 118, a lip portion corner surface 120, and a lip portion outer side surface 122. The lip portion upper surface 116 may be generally planar, and may include a ring portion 124 for moving and holding the corner segment 102 during transport and mounting or dismounting of the corner segment 102 from the bucket 100. The ring portion 114 may extend from a protruded portion 126 of the lip portion upper surface 116. The lip portion upper surface 116 may be angled relative to the mounting portion upper surface 110, so as to slope downward from the mounting portion upper surface 110 toward the lip portion front surface 118.

The lip portion front surface 118 is generally planar, and may be perpendicular to the mounting portion upper surface 110 and angled relative to the lip portion upper surface 116. An edge 128 between the lip portion upper surface 116 and the lip portion front surface 118 may be a fillet edge. The lip portion outer side surface 122 is generally planar, and may be perpendicular to the mounting portion upper surface 110 and to the lip portion front surface 118. An edge 130 between the lip portion outer side surface 122 and the lip portion upper surface 116 may be a fillet edge. The lip portion corner surface 120 is a curved surface or a curved portion that is adjacent to the planar lip portion upper surface 116, the planar lip portion front surface 118, and the planar lip portion outer side surface 122. By virtue of the curve of the lip portion corner surface 120, the lip portion corner surface 120 may be continuous, i.e., uninterrupted by an edge, with the lip portion front surface 118 and the lip portion outer side surface 122. An edge 132 between the lip portion corner surface 120 and the lip portion upper surface 116 follows a slope or angle of the lip portion upper surface 116, and may be a fillet edge.

A plurality of protrusions or inserts 134 may be provided on one or more surfaces of the lip portion 108 of the corner segment 102. For example, as shown in FIG. 2, the protrusions 134 may be provided at least on a portion of the lip portion front surface 118 and on the lip portion corner surface 120. The protrusions 134 may be integrally formed with the corner segment 102, or separately formed as inserts and attached to the corner segment 102.

Figure 3:
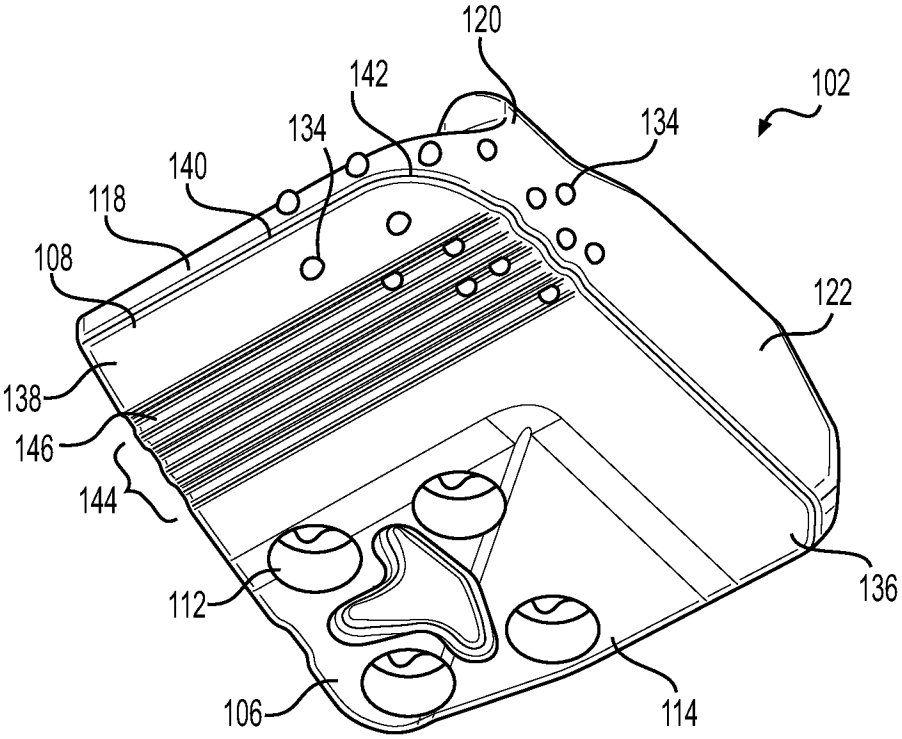
FIG. 3 shows a schematic isometric view of the corner segment shown in FIG. 2, including at least a bottom surface, the outer side surface, the corner surface, and the front surface of the corner segment.

FIG. 3 shows another schematic isometric view of the corner segment 102. The mounting portion lower surface 114 and a lip portion lower surface 136 may be generally planar and continuous with each other. As noted above, the through holes 112 extend through the mounting portion lower surface 114 from the mounting portion upper surface 110. The lip portion 108 may also have an angled lip 138 adjacent to the lip portion front surface 118 and the lip portion corner surface 120. An edge 140 between the angled lip 138 and the lip portion front surface 118 may be a fillet edge. In addition, an edge 142 between the angled lip 138 and the lip portion corner surface 120 may be a fillet edge. The angled lip 138 may be generally planar, and may extend at an angle relative to the lip portion bottom surface 136 and relative to the mounting portion bottom surface 114. The lip portion lower surface 136 may also include a ridged portion 144 having a plurality of ridges 146 expanding across a width of the corner segment 102, i.e., parallel to the lip portion front surface 118. The ridged portion 144 is adjacent to the angled lip 138. In addition, protrusions 134 may be provided on at least a portion of the angled lip 138 and on the ridged portion 144, as shown in FIG. 3.

Figure 4:
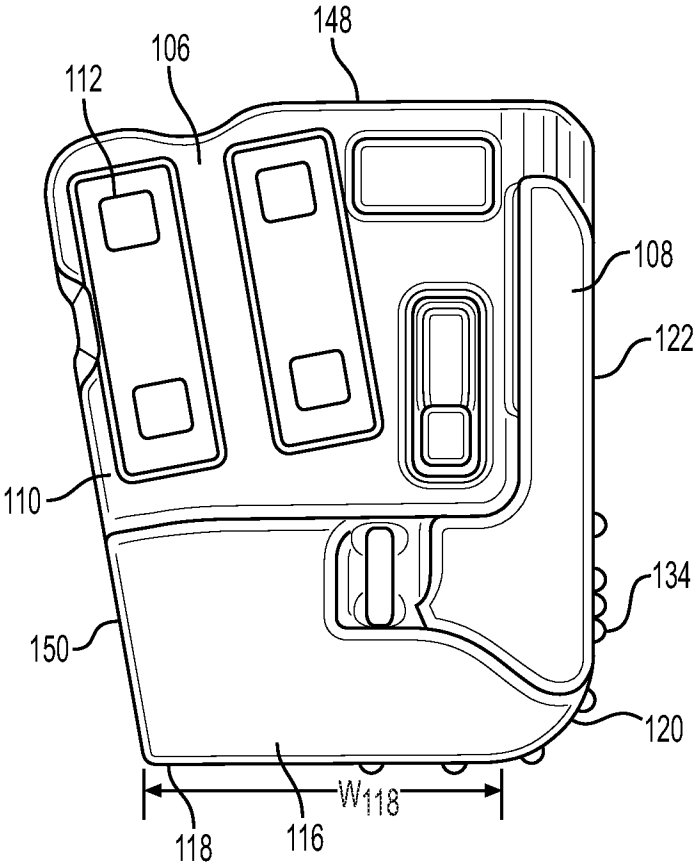
FIG. 4 shows a schematic top view of the corner segment, shown in FIGS. 2 and 3.

FIG. 4 shows a schematic top view of the corner segment 102. The corner segment 102 has a back surface 148 continuous across the recessed mounting portion 106 and the lip portion 108, and an inner side surface 150 continuous across the recessed mounting portion 106 and the lip portion 108. As shown in FIGS. 3 and 4, four through holes 112 are provided in the recessed mounting portion 106 for securing the corner segment 102 to the bucket 100. FIG. 4 also shows the protrusions 134 protruding from the lip portion front surface 118 and from the lip portion corner surface 120.

Figure 5:
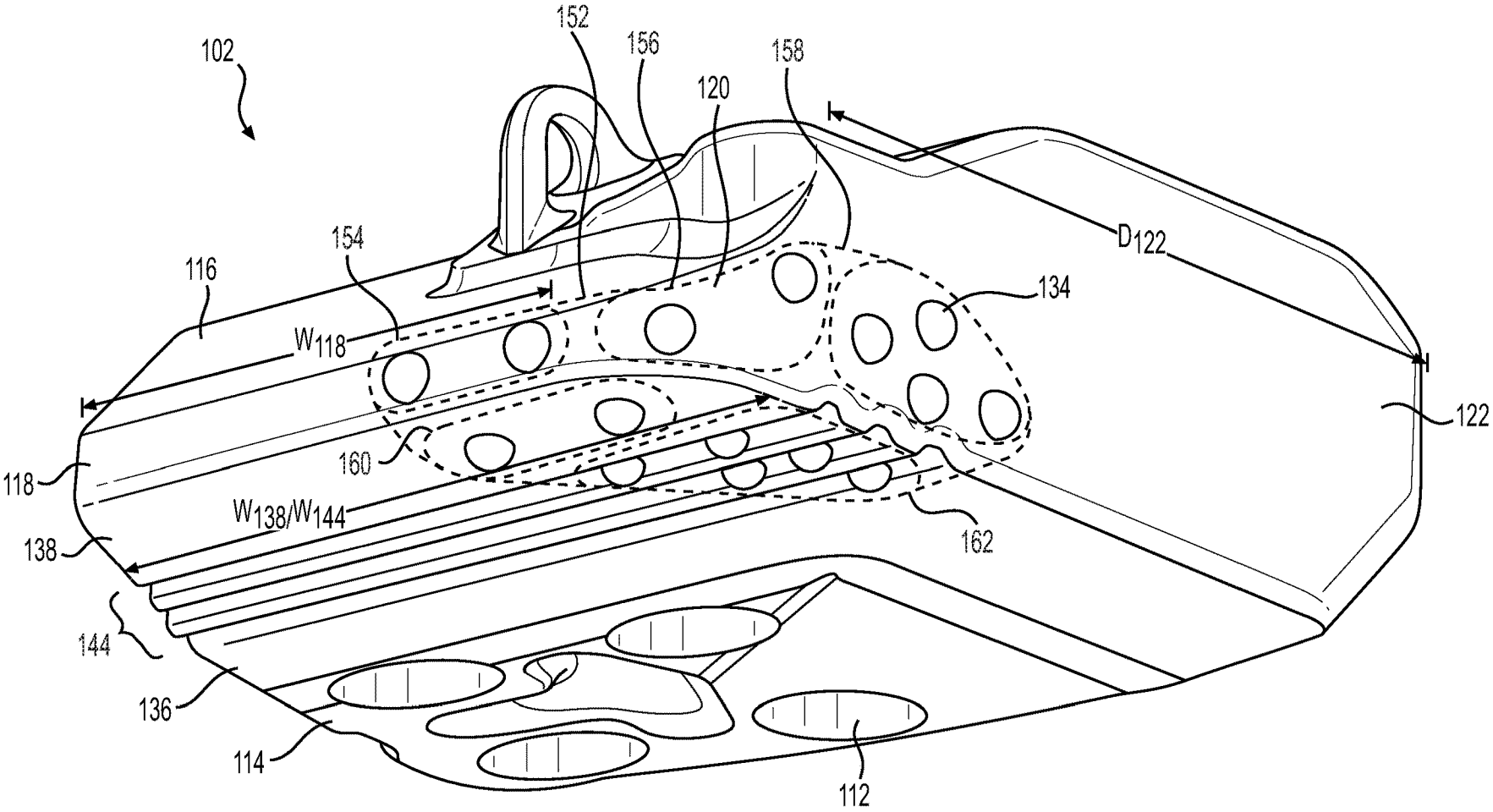
FIG. 5 shows a schematic isometric view of the corner segment shown in FIG. 2-4, including wear zones on the corner segment.

FIG. 5 shows a schematic isometric view of the corner segment 102, and, in particular, shows a wear zone 152 on which the plurality of protrusions 134 are arranged. The wear zone 152 may encompass, for example, a portion of the lip portion front surface 118, a portion of the ridged portion 144, a portion of the angled lip 138, a portion of the outer side surface 122, and the lip portion curved surface 120. The wear zone 152 is not, however, limited to these surfaces or to the portions thereof, and may encompass other surfaces or portions of surfaces on the corner segment 102. The protrusions 134 are spaced apart within the wear zone 152. As an example, each insert 134 may be spaced from an adjacent insert 134 by a spacing of 10 mm to 100 mm.

As shown in FIG. 5, with respect to a width $W_{118}$ of the lip portion front surface 118, the wear zone 152 may be limited to an outer half of the width $W_{118}$, i.e., the half of the width $W_{118}$ closest to the lip portion outer side surface 122. With respect to a width $W_{138}$ of the angled lip 138, the wear zone 152 may be limited to an outer half of the width $W_{138}$, i.e., the half of the width $W_{138}$ closest to the lip portion outer side surface 122. With respect to a depth $D_{122}$ of the lip portion outer side surface 122, the wear zone 152 may be limited to a front half, for example, of the lip portion outer side surface 122, i.e., a half of the lip portion outer side surface 122 that is closest to the lip portion front surface 118. With respect to the lip portion corner surface 120, the wear zone 152 may encompass all of the lip portion corner surface 120. And, with respect to a width $W_{144}$ of the ridged portion 144, the wear zone 150 may be limited to an outer half of the width $W_{144}$ of the ridged portion 144.

Although the wear zone 152 is shown in FIG. 5 as a singular wear zone, the wear zone 152 may be made up of a plurality of wear zones, each on a different surface of the corner segment 102. For example, the wear zone 152 may be defined by a front surface wear zone 154, a corner surface wear zone 156, an outer side surface wear zone 158, an angled lip wear zone 160, and a ridged portion wear zone 162.

Figure 6:
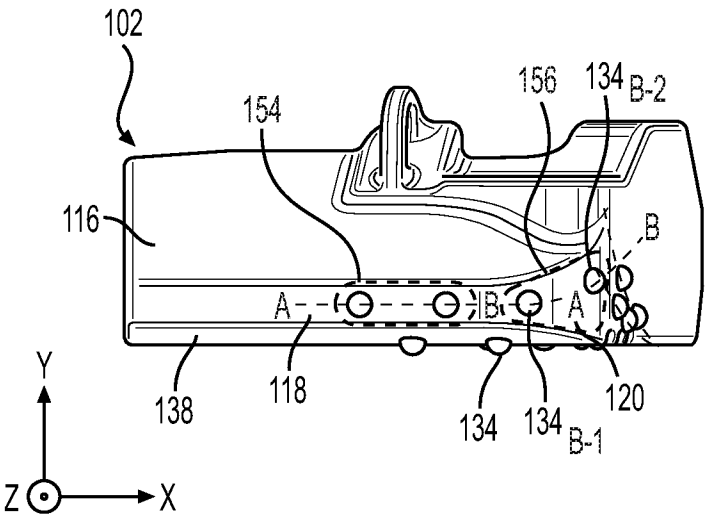
FIG. 6 shows a schematic front view of the corner segment shown in FIGS. 2-5, including an arrangement of protrusions.

Referring to FIG. 6, two protrusions 134 are provided on the front surface wear zone 154. The protrusions 134 provided on the front surface wear zone 154 may be arranged in a particular pattern. For example, as shown in FIG. 6, the protrusions 134 on the front surface wear zone 154 may be aligned along an axis A-A, which extends parallel to an x-axis, or a width $W_{118}$ of the lip portion front surface 118.

Figure 7:
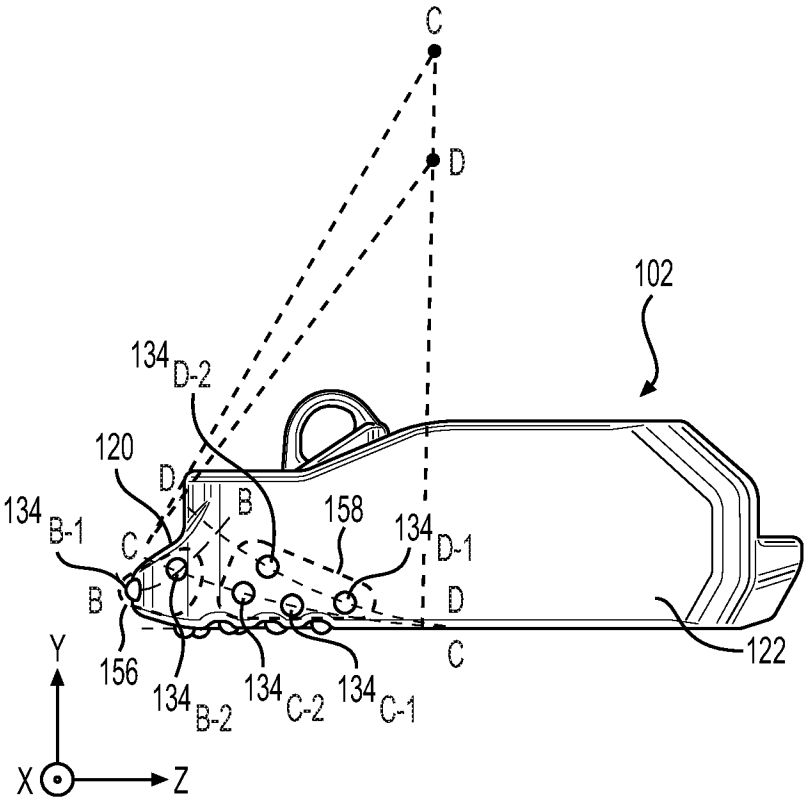
FIG. 7 shows a schematic side view of the corner segment shown in FIGS. 2-6, including the arrangement of the protrusions.

With reference to FIGS. 6 and 7, two protrusions 134 may be provided on the corner surface wear zone 156. The protrusions 134 provided on the corner surface wear zone 156 may be arranged in a particular pattern. For example, as shown in FIGS. 6 and 7, the two protrusions 134 may be positioned on an arc B-B, which extends along a curve in a plane parallel to the x-axis and a y-axis, and along a curve in a plane parallel to the y-axis and a z-axis. The arc B-B may be defined by a radius of curvature of 125 mm. With respect to a y-axis, as shown in FIGS. 6 and 7, one protrusion $\mathbf{134}_{B\text{-}1}$, of the two protrusions 134 positioned on the arc B-B, may be aligned with the protrusions 134 provided on the front surface wear zone 154, i.e., on the axis A-A. Further, the protrusion $\mathbf{134}_{B\text{-}1}$ is closer to the lip portion front surface 118 and the lip portion lower surface 136 than the protrusion $\mathbf{134}_{B\text{-}2}$, and the protrusion $\mathbf{134}_{B\text{-}2}$ is closer to the lip portion upper surface 116 and the lip portion outer side surface 122 than the protrusion $\mathbf{134}_{B\text{-}1}$. In addition, with respect to a length along the x-axis, the protrusion $\mathbf{134}_{B\text{-}2}$ may be at a greater length than the protrusion $\mathbf{134}_{B\text{-}1}$, with respect to a height along the y-axis, the protrusion $\mathbf{134}_{B\text{-}2}$ may be higher than the protrusion $\mathbf{134}_{B\text{-}1}$, and, with respect to a depth along the z-axis, the protrusion $\mathbf{134}_{B\text{-}2}$ may be at a greater depth than the protrusion $\mathbf{134}_{B\text{-}1}$.

In addition, four protrusions 134 may be provided on the outer side surface wear zone 158. The protrusions 134 provided on the outer side surface wear zone 158 may be arranged in a particular pattern. For example, as shown in FIG. 7, two of the protrusions 134 may be positioned along an arc C-C, which extends along a curve in a plane parallel to the y-axis and the z-axis. The arc C-C may be defined by a radius of curvature of approximately 670 mm, for example. And, as shown in FIG. 7, two of the protrusions 134 may be positioned along an arc D-D, which extends along another curve in the plane parallel to the y-axis and the z-axis. The arc D-D may be defined by a radius of curvature of approximately 330 mm, for example. The radius of curvature of the arc D-D may be less than the radius of curvature of the arc C-C. In addition, the radius of curvature of the arc C-C and the radius of curvature of the arc D-D may be non-concentric. That is, a center C, from which the radius of curvature of arc C-C extends, and a center D, from which the radius of curvature of the arc D-D extends, may be offset from each other with respect to the y-axis. As an example, an offset distance between the center C and the center D may be approximately 340 mm. Further, of the two protrusions 134 provided on the arc C-C on the outer side surface wear zone 158, one protrusion $\mathbf{134}_{C\text{-}1}$ may be closest to the ridged portion 144, and another protrusion $\mathbf{134}_{C\text{-}2}$, of the protrusions 134 provided on the arc C-C, may be closest to the lip portion corner surface 120 and the lip portion upper surface 116. With respect to a height along the y-axis, the protrusion $\mathbf{134}_{C\text{-}2}$ may be higher than the protrusion $\mathbf{134}_{C\text{-}1}$, and, with respect to a depth along the z-axis, the protrusion $\mathbf{134}_{C\text{-}2}$ may be at a greater depth than the protrusion $\mathbf{134}_{C\text{-}1}$. And, of the two protrusions 134 provided on the arc D-D on the outer side surface wear zone 158, one protrusion $\mathbf{134}_{D\text{-}1}$ may be closest to the ridged portion 144, and another protrusion $\mathbf{134}_{D\text{-}2}$ may be closest to the lip portion corner surface 120 and the lip portion upper surface 116. In addition, with respect to a height along the y-axis, the protrusion $\mathbf{134}_{D\text{-}2}$ may be higher than the protrusion $\mathbf{134}_{D\text{-}1}$, and, with respect to a depth along the z-axis, the protrusion $\mathbf{134}_{D\text{-}1}$ may be at a greater depth than the protrusion $\mathbf{134}_{D\text{-}2}$.

Figure 8:
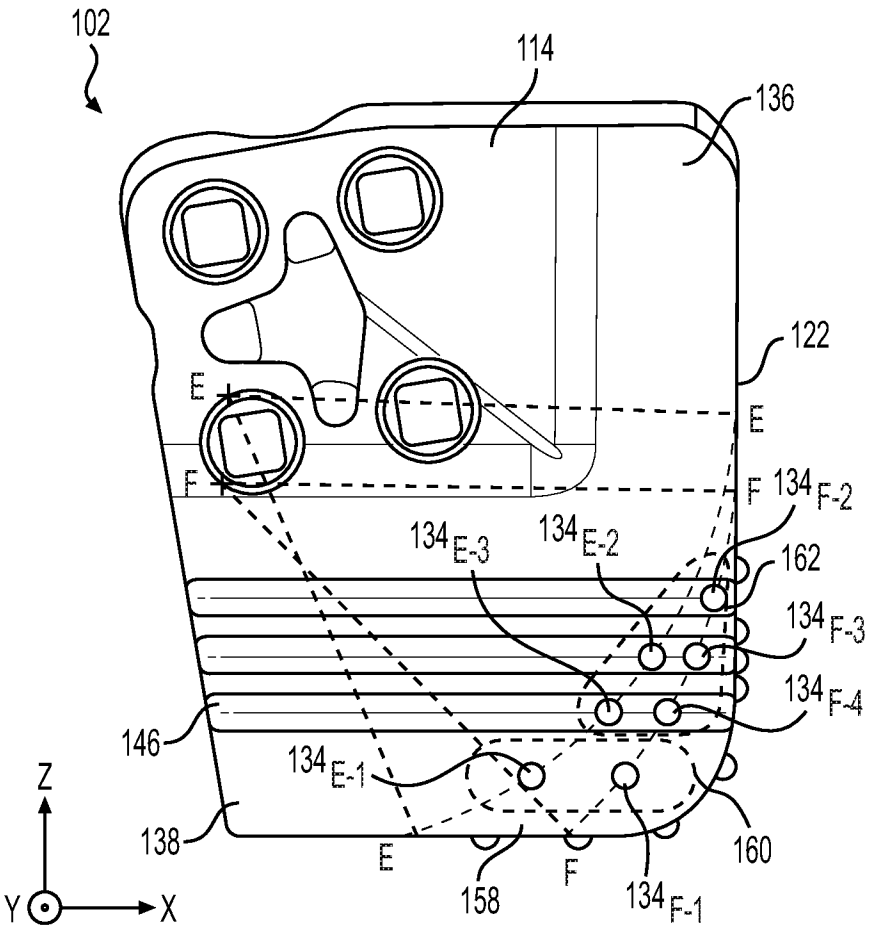
FIG. 8 shows a schematic bottom view of the corner segment shown in FIGS. 2-7, including the arrangement of the protrusions.

Referring to FIG. 8, two protrusions 134 may be provided on the angled lip wear zone 160, and five protrusions 134 may be provided on the ridged portion wear zone 162. The inserts 134 provided on the ridged portion wear zone 162 may be provided in recesses of the plurality of ridges 146, as shown in FIG. 8. As with the protrusions 134 provided on the other wear zones, the protrusions 134 provided on the angled lip wear zone 160 and on the ridged portion wear zone 162 may be arranged in a particular pattern. For example, as shown in FIG. 8, three protrusions 134 may be positioned along on an arc E-E, which extends along a curve in a plane parallel to the x-axis and the z-axis. The arc E-E may be defined by a radius of curvature of approximately 285 mm, for example, and may extend across the angled lip wear zone 160 and the ridged portion wear zone 162. In addition, four protrusions 134 may be positioned along an arc F-F, which extends along another curve in the plane parallel to the x-axis and the z-axis. The arc F-F may be defined by a radius of curvature of approximately 290 mm, for example, and may extend across angled lip wear zone 160 and the ridged portion wear zone 162. The radius of curvature of the arc F-F may be greater than the radius of curvature of the arc E-E. The radius of curvature of the arc E-E and the radius of curvature of the arc F-F may be non-concentric. In particular, a center E, from which the radius of curvature of arc E-E extends, and a center F, from which the radius of curvature of the arc F-F extends, may be offset from each other with respect to the z-axis and with respect to the x-axis, as shown. As an example, and offset distance between the center E and the center F may be approximately 40 mm.

In addition, of the three protrusions 134 positioned along the arc E-E, one protrusion $\mathbf{134}_{E\text{-}1}$ may be closest to the lip portion front surface 118 and closest to the inner side surface 150, one protrusion $\mathbf{134}_{E\text{-}2}$ may be closest to the lip portion outer side surface 122, and another protrusion $\mathbf{134}_{E\text{-}3}$ may be positioned between the protrusions $\mathbf{134}_{E\text{-}1}$ and $\mathbf{134}_{E\text{-}2}$. That is, with respect to a depth along the z-axis, the protrusion $\mathbf{134}_{E\text{-}2}$ may be at a greater depth than the protrusion $\mathbf{134}_{E\text{-}3}$, and the protrusion $\mathbf{134}_{E\text{-}3}$ may be at a greater depth than the protrusion $\mathbf{134}_{E\text{-}1}$. In addition, with respect to a length along the x-axis, the protrusion $\mathbf{134}_{E\text{-}2}$ may be at a greater length than the protrusion $\mathbf{134}_{E\text{-}3}$, and the protrusion $\mathbf{134}_{E\text{-}3}$ may be at a greater length than the protrusion $\mathbf{134}_{E\text{-}1}$. The other protrusion $\mathbf{134}_{E\text{-}3}$ may closer to the protrusion $\mathbf{134}_{E\text{-}2}$ than the protrusion $134_{E-1}$. In addition, the protrusion $134_{E-2}$ and the protrusion $134_{E-3}$ may be positioned within ridges 146 of the ridged portion 144.

Of the four protrusions 134 positioned along the arc F-F, one protrusion $134_{F-1}$ may be closest to the lip portion front surface 118 and closest to the inner side surface 150, and one protrusion $134_{F-2}$ may be closest to the lip portion outer side surface 122 and closest to the back surface 148. The other two protrusions $134_{F-3}$ and $134_{F-4}$ are positioned between the protrusion $134_{F-1}$ and the protrusion $134_{F-2}$ along the arc F-F. The protrusions $134_{F-2}$, $134_{F-3}$, and $134_{F-4}$ may be positioned within ridges 146 of the ridged portion 144. With respect to a length along the x-axis, the protrusion $134_{F-2}$ may be at a greater length than the protrusion $134_{F-3}$, the protrusion $134_{F-3}$ may be at a greater length than the protrusion $134_{F-4}$, and the protrusion $134_{F-4}$ may be at a great length than the protrusion $134_{F-1}$. And, with respect to a depth along the z-axis, the protrusion $134_{F-2}$ may be at a greater depth than the protrusion $134_{F-3}$, the protrusion $134_{F-3}$ may be at a greater depth than the protrusion $134_{F-4}$, and the protrusion $134_{F-4}$ may be at a greater depth than the protrusion $134_{F-1}$.

Figure 9:
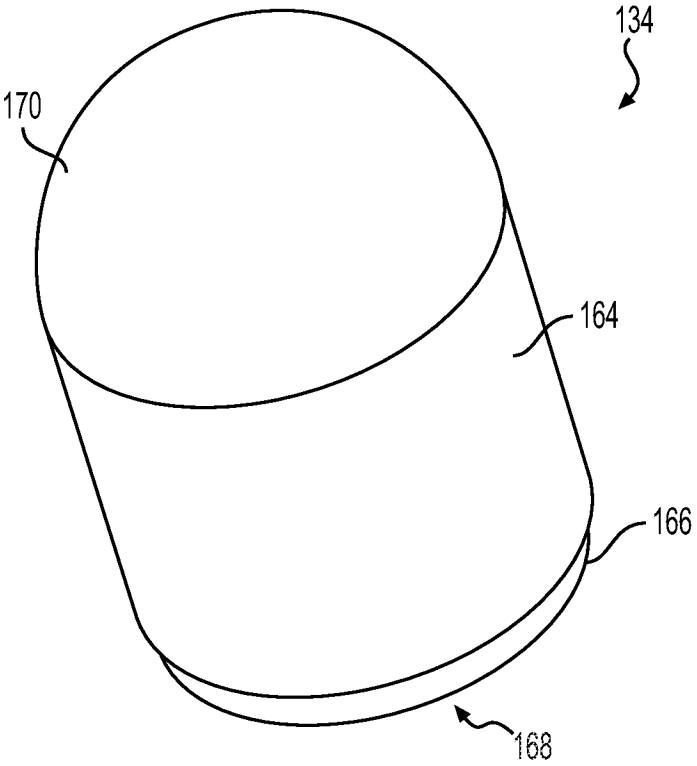
FIG. 9 shows an isometric schematic view of a protrusion of the corner segment shown in FIGS. 2-8.

FIG. 9 shows an isometric schematic view of an insert 134. The insert 134 may have a cylindrical base portion 164 with a chamfered bottom edge 166 and a bottom surface 168. The base portion 164 may be approximately 16 mm in height. The base portion 164 is configured to be inserted and fixed within holes in the lip portion front surface 118, the lip portion corner surface 120, the lip portion outer side surface 122, the lip portion lower surface 136, and the angled lip 138 of the corner segment 120. A diameter of the base portion 164 may be approximately 18 mm. The diameter of the base portion 164 may correspond to a diameter of a hole in the corner segment 102, into which the protrusions 134 are inserted. The diameter of the base portion 164 may also be greater than the diameter of the hole in the corner segment 102 by, for example, 0.055 mm, so as to form an interference fit between the insert 134 and the hole in the corner segment 102. The difference between the diameter of the base portion 164 and the diameter of the hole in the corner segment 102 is not, however, limited to 0.055 mm, and may be, for example, in a range of 0.050 to 0.060 mm.

The insert 134 also may have a semi-spherical, or dome-shaped top portion 170. The top portion 170 may have a height of approximately 9 mm. The top portion 170 is configured to protrude from the surface of the lip portion 108 on which the insert 134 is inserted. That is, when installed or inserted into the holes formed in the surfaces of the corner segment 102, the protrusions 134 protrude from the respective surfaces by approximately 9 mm. The holes formed on the surfaces of the corner segment 102 may be cast or machined, for example.

The protrusions 134 may be formed of a material having a greater hardness than that of a material that forms the corner segment 102. For example, the protrusions 134 may be formed of one of tungsten carbide, ceramic, industrial diamond, or a combination thereof.

INDUSTRIAL APPLICABILITY

The corner segment 102 of the present disclosure, and, in particular, the corner segment 102 having the protrusions 134 provided on the wear zone 152, provides an easily replaceable GET for a work implement, such as the bucket 100, that reduces uneven wear and thereby prolongs the overall life of the GET. In addition, the particular arrangement of the protrusions 134 on wear zones of the corner segment 102 of the present disclosure reduces wear along curved and angled surfaces of the corner segment 102.

The lip portion upper surface 116, the lip portion front surface 118, the lip portion corner surface 120, the lip portion outer side surface 122, the lip portion bottom surface 136, and the angled lip 138 of the corner segment 102 are working surfaces. That is, when the corner segment 102 is mounted to the bucket 100, and the bucket 100 is in use, these surfaces of the lip portion 108 engage the material being moved by the bucket 100.

The arrangement of the protrusions 134 on the wear zone 152 serves to reduce accelerated wear on the surfaces of the corner segment 102 that engage the material. More specifically, the arrangements of the protrusions 134 on each of the front surface wear zone 154, shown in FIG. 6, the corner surface wear zone 156 and the outer side surface wear zone 158, shown in FIG. 7, the angled lip wear zone 160 shown in FIG. 8, and the ridged portion wear zone 162 shown in FIG. 8, reduce the rate of wear on the lip portion front surface 118, the lip portion corner surface 120, the lip portion outer side surface 122, the angled lip 138, and the ridged portion 144, respectively, of the lip portion 108 of the corner segment 102. The arrangement of the protrusions 134 may be limited to these surfaces of the corner segment 102, i.e., the protrusions 134 may not be arranged on other surfaces of the corner segment 102. That is, the arrangement of the protrusions 134 may be limited to the wear zones so as to reduce accelerated wear of the material that forms the corner segment 102 in the wear zones.

By providing the protrusions 134 on an angled lip 138 and on the ridged portion 144, and not providing protrusions 134 on other portions of the lip portion bottom surface 136 or the mounting portion bottom surface 114, bottom surfaces of corner segment 102, including the lip portion bottom surface 136 and the mounting portion bottom surface 114 of the corner segment 102, can remain on plane with respect to a bottom surface of the bucket 100, and with respect to a working surface, such as a flat ground surface. In addition, by providing the protrusions 134 on the lip portion front surface 118, the lip portion corner surface 120, and the lip portion outer side surface 122, and not on the lip portion upper surface 116, the lip portion upper surface 116 remains planar and sharp for biting into a material to be moved by the bucket 100.

Further, providing the protrusions 134 on the lip portion front surface 118, the lip portion corner surface 120, and the lip portion outer side surface 122 prevents wash-out of the material of the lip portion 108 that holds the protrusions 134 in the holes on the angled lip portion 138 and on the ridged portion 144. That is, without the protrusions 134 on the lip portion front surface 118, the lip portion corner surface 120, and the lip portion outer side surface 122, the material that forms the lip portion 108 is susceptible to wear on the lip portion front surface 118, the lip portion corner surface 120, and the lip portion outer side surface 122. As the material wears on the lip portion front surface 118, for example, the holes formed in the angled lip 138 and in the ridged portion 144 may be exposed. That is, the lip portion front surface 118 loses material due to wear, resulting in exposure or opening up of the holes formed in the angled lip 138 and in the ridged portion 144. As a result, the interference fit maintaining the protrusions 134 in those holes may be lost, and the protrusions 134 may fall out. Thus, the addition of protrusions 134 on the lip portion front surface 118, the lip portion corner surface 120, and the lip portion outer surface 122 provide the additional benefit of preventing loss of the protrusions 134 on the angled lip 138 and on the ridged portion 144, in addition to reducing wear on those surfaces of the lip portion 108, and prolonging the overall life of the bucket 100.

To install the protrusions 134 on the corner segment 102, a plurality of holes may be cast, machined, drilled, or otherwise formed in the lip portion front surface 118, the lip portion corner surface 120, the lip portion outer side surface 122, the angled lip 138, and the ridged portion 144. The positions of the drilled holes on the surfaces of the corner segment 102 correspond to the arrangement of the protrusions 134, such as the arrangement shown in FIGS. 5-8. A diameter of each of the drilled holes may be slightly smaller than a diameter of the base portion 164 of the insert 134. The protrusions 134 are then press fit into the drilled holes, and are thereby secured to the corner segment 102. Alternatively, the diameter of each of the drilled holes may be equal to the diameter of the insert 134, and each insert 134 may be secured within one of the drilled holes by brazing, or by use of an adhesive or an epoxy between the bottom surface 168 of the insert 134 and the drilled hole.

The corner segment 102 with protrusions 134 of the present disclosure provides a GET that reduces accelerated wear on some surfaces or a portion of surfaces of the GET, or balances wear more evenly across the surfaces of the component, by virtue of the arrangement of the protrusions 134 on one or more wear zones. As a result, the corner segment 102 with protrusions 134 may require less frequent replacement as compared to that of a conventional GET. In addition, the corner segment 102 with protrusions 134 also provides a component that can be used on planar, angled, and/or curved surfaces of a work implement, such as a bucket. Further, installation or replacement of the corner segment 102 with protrusions 134 is relatively simple, in that it may not require burning, cutting, or welding, and may require relatively less machinery and manual labor as compared to a welded wear plate, for example. Further, replacement of the corner segment 102 with the protrusions 134 may incur less downtime, as compared to replacement of a welded wear plate or replacement of the work implement. As a result, the replaceable corner segment 102 with protrusions 134 of the present disclosure reduces the time, cost, machinery, and/or manual labor needed to replace a GET and/or components thereof.

The geometric shapes, geometric relationships, and dimensions of the surfaces, edges, and through holes of the corner segment 102, and of the portions and edges of the protrusions 134, as described above, are examples, and other geometric shapes, geometric relationships, and dimensions may be used. The materials that form the corner segment 102 and the protrusions 134 described above are examples, and other materials may be used.

The wear zones described herein, and their relationships to the surfaces of the corner segment 102, are examples, and other wear zones or relationships of wear zones to surfaces may be used. For example, the front surface wear zone 154 may be only on an outer third of the width $W_{118}$ of the lip portion front surface 118, i.e., the third of the width $W_{118}$ closest to the lip portion outer side surface 122. Similarly, the angled lip wear zone 160 may only be on an outer third of the width $W_{138}$ of the angled lip 138, i.e., the third of the width $W_{138}$ that is closest to the lip portion outer side surface 122. Further, the ridged portion wear zone 162 may only be on an outer third of the width $W_{144}$ of the ridged portion 144, i.e., the third of the width $W_{144}$ that is closest to the lip portion outer side surface 122.

In addition, the arrangements and patterns of the protrusions 134 on each wear zone are examples, and other arrangements or patterns may be used. For example, the radii of curvature of the arcs along which the protrusions 134 are arranged may differ from the values noted above. In addition, the relationships between the radii of curvature may differ from the relationships described above. Moreover, the offset distance between the center C and the center D, and the offset distance between the center E and the center F may differ from the distances noted above. Alternatively, the center C and the center D may be concentric, and the center E and the center F may be concentric. And, for example, with reference to FIG. 7, a portion or all of the protrusions 134 provided on the corner surface wear zone 154 and the outer side surface wear zone 156 may be arranged in a staggered pattern. A staggered pattern may be, for example, an alternating pattern relative to a plane on the y-axis and the z-axis, with equally spaced apart protrusions 134. Although the protrusions 134 may be equally spaced apart, spacing between the protrusions 134 may vary. Further, although the embodiment described herein and shown in FIGS. 2-8 includes a particular number of protrusions 134 on each of the wear zones, the number of protrusions 134 on each wear zone is not limited, and may be greater than or less than the number of inserts described and shown.

Further, the corner segment 102 with the protrusions 134 provided in one or more wear zones may be used on a work implement of any type, size, or configuration. That is, the shapes, geometric relationships, and dimensions of the corner segment, the particular locations and sizes of the wear zones, and the arrangement of the inserts in the wear zones may be subject to change based on the type, the size, or the configuration of the work implement.

It will be apparent to those skilled in the art that various modifications and variations can be made to the disclosed corner segment without departing from the scope of the disclosure. Other embodiments of the corner segment will be apparent to those skilled in the art from consideration of the specification and the accompanying figures. It is intended that the specification, and, in particular, the examples provided herein be considered as exemplary only, with a true scope of the disclosure being indicated by the following claims and their equivalents.

We claim:

1. A corner segment configured to be mounted to a work implement, the corner segment comprising:

a body having a plurality of surfaces including:

a rear surface;

an upper surface;

a front surface;

a bottom surface;

an outer side surface;

an inner side surface; and a corner surface that is adjacent to each of the front surface, the outer side surface, the upper surface, and the bottom surface, wherein a portion of the bottom surface forms a bottom surface wear zone, and a portion of the front surface forms a front surface wear zone; and a plurality of protrusions provided on each of the bottom surface wear zone and the front surface wear zone, wherein the bottom surface includes a planar portion, a ridged portion adjacent to the planar portion, and an inclined portion that is adjacent to the ridged portion and to the front surface, and that is angled relative to the planar portion, the ridged portion and the inclined portion having the bottom surface wear zone with protrusions.

2. The corner segment of claim 1, wherein the bottom surface wear zone is formed only on an outer half of the bottom surface that is adjacent to the corner surface.

3. The corner segment of claim 1, wherein the front surface wear zone is formed only on an outer half of the front surface that is adjacent to the corner surface.

4. The corner segment of claim 1, wherein the corner surface forms a corner surface wear zone and a portion of the outer side surface forms a side surface wear zone.

5. The corner segment of claim 4, wherein the side surface wear zone is formed only on an edge of the side surface that is adjacent to the corner surface.

6. The corner segment of claim 4, wherein front surface protrusions, of the plurality of protrusions, are provided on the front surface wear zone, and are aligned along a width of the front surface, wherein bottom surface protrusions, of the plurality of protrusions, are provided on the bottom surface wear zone, and are positioned along at least one arc that extends across the bottom surface, wherein side surface protrusions, of the plurality of protrusions, are provided on the side surface wear zone, and are positioned along at least one arc that extends across the side surface, and wherein corner surface protrusions, of the plurality of protrusions, are provided on the corner surface wear zone, and are positioned along at least one arc that extends across the corner surface.

7. The corner segment of claim 1, wherein the plurality of protrusions are evenly spaced from each other.

8. The corner segment of claim 1, wherein the plurality of protrusions are formed of a material having a greater hardness than a material that forms the body of the corner segment.

9. A corner segment configured to be mounted to a work implement, the corner segment comprising:

a body including:

a mounting portion having a mounting portion outer side surface; and a lip portion, integrally formed with the mounting portion, the lip portion having:

a lip portion front surface;

a lip portion upper surface;

a lip portion bottom surface; and a lip portion outer corner surface that is adjacent to each of the lip portion front surface, the lip portion upper surface, the lip portion bottom surface, and the mounting portion outer side surface, wherein a portion of the lip portion bottom surface forms a bottom surface wear zone, and a portion of the lip portion front surface forms a front surface wear zone; and a plurality of protrusions provided on each of the bottom surface wear zone and the front surface wear zone, wherein the bottom surface of the lip portion includes an angled lip portion that extends at an angle relative to the bottom surface of the mounting portion, and a ridged portion.

10. The corner segment of claim 9, wherein the bottom surface wear zone is formed only on an outer half of the lip portion bottom surface that is adjacent to the lip portion corner surface.

11. The corner segment of claim 9, wherein the front surface wear zone is formed only on an outer half of the lip portion front surface that is adjacent to the lip portion corner surface.

12. The corner segment of claim 9, wherein the corner surface forms a corner surface wear zone and a portion of the outer side surface forms a side surface wear zone.

13. The corner segment of claim 12, wherein the side surface wear zone is formed only on an edge of the mounting portion outer side surface that is adjacent to the lip portion corner surface.

14. The corner segment of claim 13, wherein front surface protrusions, of the plurality of protrusions, are provided on the front surface wear zone, and are aligned along a width of the lip portion front surface, wherein bottom surface protrusions, of the plurality of protrusions, are provided on the bottom surface wear zone, and are positioned along at least one arc that extends across the lip portion bottom surface, wherein side surface protrusions, of the plurality of protrusions, are provided on the side surface wear zone, and are positioned along at least one arc that extends across the mounting portion outer side surface, and wherein corner surface protrusions, of the plurality of protrusions that are provided on the corner surface wear zone, are arranged in a staggered pattern on the lip portion corner surface.

15. The corner segment of claim 9, wherein the plurality of protrusions are evenly spaced from each other.

16. The corner segment of claim 9, wherein the plurality of protrusions are formed of a material having a greater hardness than a material that forms the body of the corner segment.

* * * * *